US007124899B1

(12) United States Patent
Wright

(10) Patent No.: US 7,124,899 B1
(45) Date of Patent: Oct. 24, 2006

(54) GOLF CLUB HOLDING RACK

(76) Inventor: Rondal Brent Wright, 115 Rebecca La., Glasgow, KY (US) 42141

( * ) Notice: Subject to any disclaimer, the term of this patent is extended or adjusted under 35 U.S.C. 154(b) by 67 days.

(21) Appl. No.: 10/715,156

(22) Filed: Nov. 17, 2003

(51) Int. Cl.
*A63B 55/00* (2006.01)

(52) U.S. Cl. ..... 211/70.2

(58) Field of Classification Search ..... 211/70.2, 211/51, 59.3, 195
See application file for complete search history.

(56) References Cited

U.S. PATENT DOCUMENTS

| | | | | |
|---|---|---|---|---|
| 4,735,425 | A | 4/1988 | Hoff | |
| D318,090 | S | 7/1991 | Bahns | |
| 5,080,239 | A | 1/1992 | Rowland | |
| 5,103,974 | A | 4/1992 | Antonious | |
| D326,771 | S | 6/1992 | Bukovac | |
| 5,127,530 | A | 7/1992 | Ortuno | |
| 5,188,243 | A * | 2/1993 | Ruiz | 211/70.2 |
| D338,048 | S | 8/1993 | Finley | |
| 5,238,109 | A | 8/1993 | Smith | |
| 5,285,990 | A | 2/1994 | Engel | |
| D348,712 | S | 7/1994 | Parker, Jr. | |
| 5,332,090 | A | 7/1994 | Tucker | |
| 5,390,916 | A | 2/1995 | Govoni | |
| D361,207 | S | 8/1995 | Meyer | |
| 5,437,449 | A | 8/1995 | Zink | |
| D362,289 | S | 9/1995 | Ratte | |
| 5,467,980 | A | 11/1995 | Weisenstein | |
| 5,470,095 | A | 11/1995 | Bridges | |
| D364,912 | S | 12/1995 | Sowers | |
| 5,492,230 | A | 2/1996 | Horton | |
| 5,503,394 | A * | 4/1996 | Mauck et al. | 473/386 |
| D371,590 | S | 7/1996 | Ludwig | |
| 5,597,363 | A | 1/1997 | Leote | |
| 5,636,734 | A | 6/1997 | Smith | |
| 5,669,514 | A | 9/1997 | Massetti | |
| 5,725,095 | A | 3/1998 | Beck et al. | |
| 5,730,404 | A | 3/1998 | Evans et al. | |
| 5,782,704 | A | 7/1998 | Tetler et al. | |
| 5,820,479 | A | 10/1998 | Cline et al. | |
| 5,842,564 | A * | 12/1998 | Clement | 206/315.2 |
| D407,774 | S | 4/1999 | Weiss | |
| 5,950,823 | A * | 9/1999 | Flis | 206/315.2 |
| D418,186 | S | 12/1999 | Canterbury | |
| 6,213,314 | B1 | 4/2001 | Beemer | |
| 6,293,313 | B1 | 9/2001 | McCrink | |
| 6,309,308 | B1 | 10/2001 | Bennett | |

* cited by examiner

*Primary Examiner*—Sarah Purol

(57) ABSTRACT

An extendable and retractable golf club holding rack, which is designed to be mounted in a stationary position in the ground. In the retracted position, a holding rack is set within an outer wall of an outer housing. A latching mechanism maintains the holding rack inside the outer housing. Upon release of the latching mechanism, the holding rack extends via a spring mechanism above the outer housing and above ground level. The top portion of the holding rack has elongated slotted openings for receiving golf clubs. After use, the holding rack is pushed in a downward motion, which allows the latching mechanism to re-engage, maintaining the holding rack in the retracted position within the outer housing.

2 Claims, 9 Drawing Sheets

GOLF CLUB HOLDING RACK

BACKGROUND OF THE INVENTION

This invention relates primarily to a golf club holding rack, which is enclosed in an outer housing assembly and when in use is placed in the ground with only the top surface uncovered. The golf club holding rack extends from the outer housing assembly and provides a means for supporting and securely retaining single or multiple golf clubs in the vertical position for ease of access. The golf club holding rack is then retractable back into the outer housing assembly after the user is finished using the holding rack.

SUMMARY OF THE INVENTION

This invention will be utilized primarily by golfers. While playing the game of golf or while practicing the stroking of the ball, the golfer will often utilize many different clubs to achieve the appropriate effect on the golf ball. The golf clubs used by golfers are often expensive, and golfers therefore take measures to protect the clubs. Oftentimes when a golfer's ball approaches the green, he will take more than one club with him to the green to accommodate the type of swing needed for the ball to be accurately hit onto the green and then into the cup. In this situation, in order for a golfer to utilize the first golf club, he must place the second golf club on the ground. The ground could be wet, causing the golf club to become wet or dirty, an undesirable condition. Also, after using the second golf club, the golfer may forget to pick up the first golf club which has been laid down on the course at a position away from the cup.

The present invention is a new design of a multiple cavity, extendable and retractable golf club holding rack. The golf club holding rack is a method of supporting and securely retaining single or multiple golf clubs in the vertical position for ease of access. Prior art discloses golf club support stands that the user must carry along with him. The present invention is designed so that it is mounted into the ground and remains in a stationary position. The golf club holding rack can be used by one or multiple users if placed on a golf course. When a golfer is in need of the golf club holding rack, the rack is placed in an extended position. After its use, the golfer can simply push the golf club holding rack into the retracted position, to be used at another time by another golfer. Use of the golf club holding rack both protects the clubs and allows the user to easily access the club. The golf club holding rack also helps to ensure that golf clubs will not be inadvertently left behind by golfers. The primary application of the present invention will be on golf courses, golf training courses, golf practice and putting greens, and golf driving ranges.

The present invention has a holding rack comprised of an upper stand and lower stand which are connected by a connector tube at a fixed distance. In the retracted position, the holding rack is set within the outer wall of the outer housing. The latching mechanism of the upper stand is engaged which retains the holding rack in the outer housing. When the push button, located on the upper stand, is depressed downward using the end of the golf club or another similar item, the latching mechanism of the upper stand is released. Once the latching mechanism is disconnected, a spring mechanism forces the holding rack from the top end of the outer housing, above ground level. Only the upper stand and the connector tube are extended from the outer housing. The lower stand is maintained within the outer housing by either a latching mechanism or a damper mechanism.

Once extended, the golf clubs may be inserted into each or any of the elongated slotted openings of the upper stand for holding. At the desired time of use, the golfer, using their foot, pushes the upper stand in a downward motion, which allows the holding rack to move into the retracted position and the latching mechanism to become engaged.

DETAILED DESCRIPTION OF THE DRAWINGS

Figure 1:
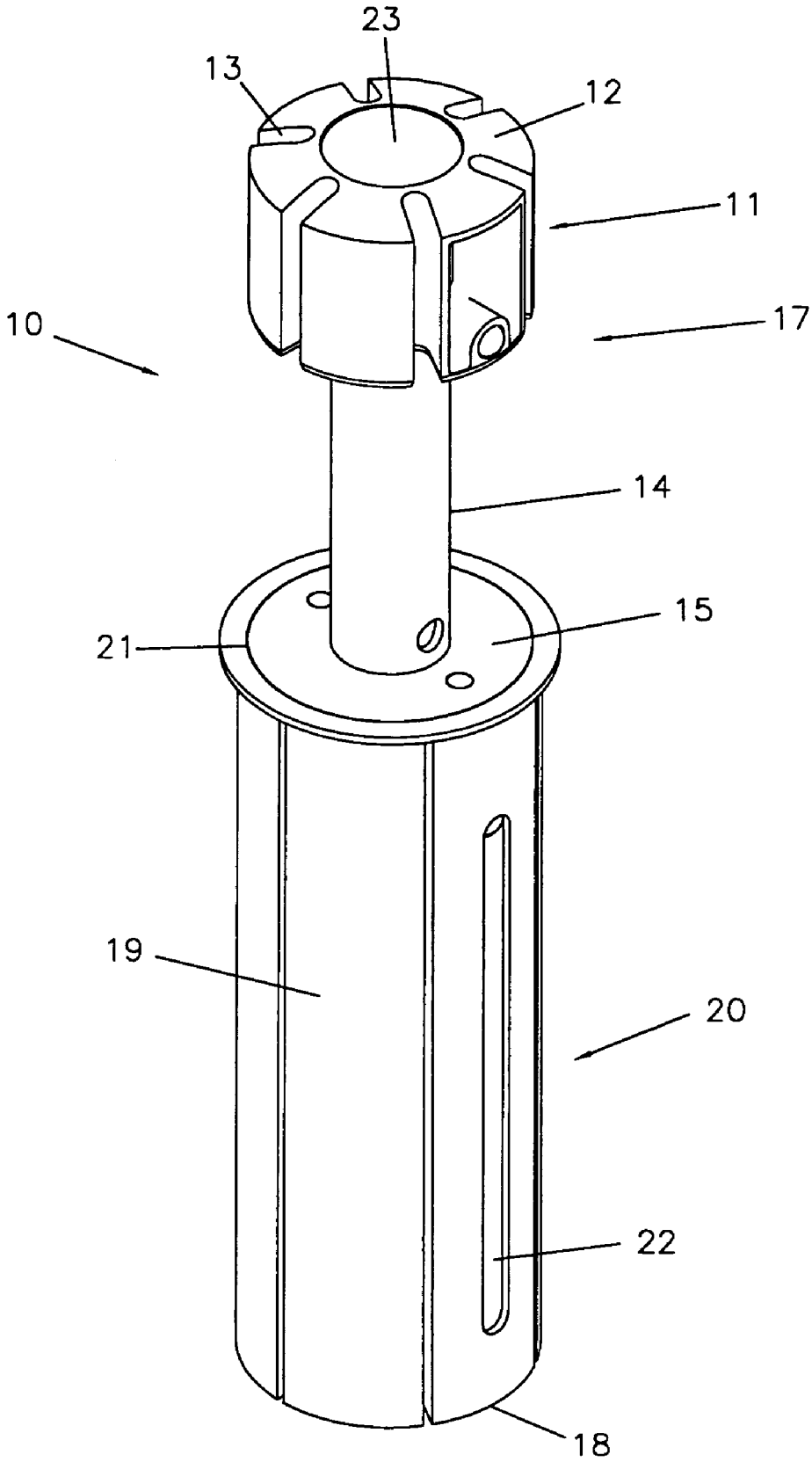
FIG. 1 is an elevated perspective view of the present invention in an extended position.
Figure 2:
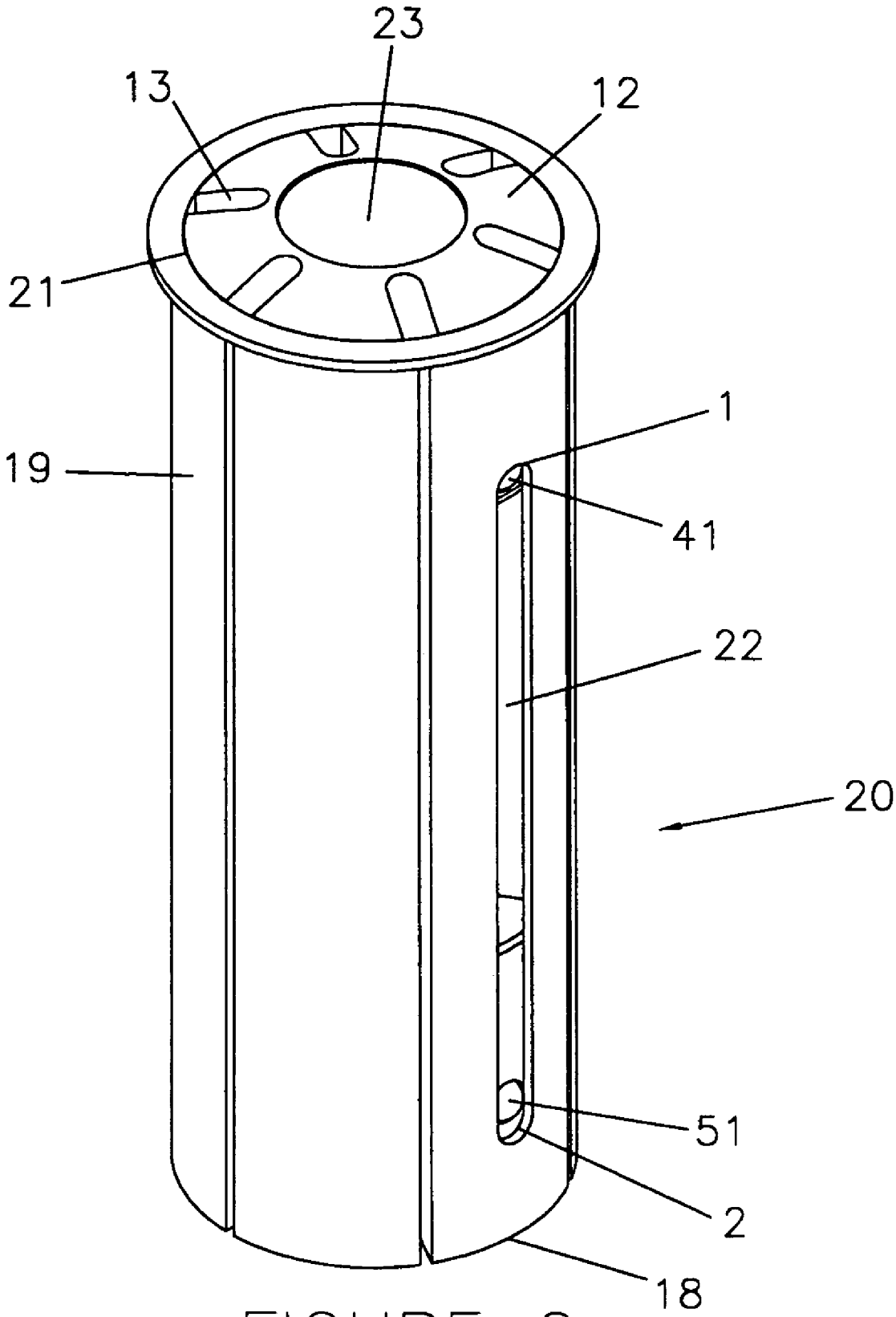
FIG. 2 is an elevated perspective view of the present invention in a retracted position.

The golf club holding rack 10 has an outer housing 20 assembly which is designed to be mounted underground. The outer housing 20 assembly has an outer wall 19 and is cylindrical, as is shown in FIGS. 1 and 2. The outer housing 20 has a bottom surface 18 but is open at the top end 21.

A holding rack 17, as is shown in FIG. 1, is used to actually support the golf clubs when the present invention is in use. The holding rack 17 is comprised of an upper stand 11, a connector tube 14 and a lower stand 15. The upper stand 11 is cylinder shaped and has a plurality of slotted openings 13 circling the circumference and directed toward the axis. There is also a lower stand 15, which is also cylinder shaped. The upper and lower stands 11, 15 are connected by a connector tube 14 that joins the two at a fixed distance. The connector tube 14 is tubular in shape and has a lengthwise hole passing through its central axis.

Figure 4:
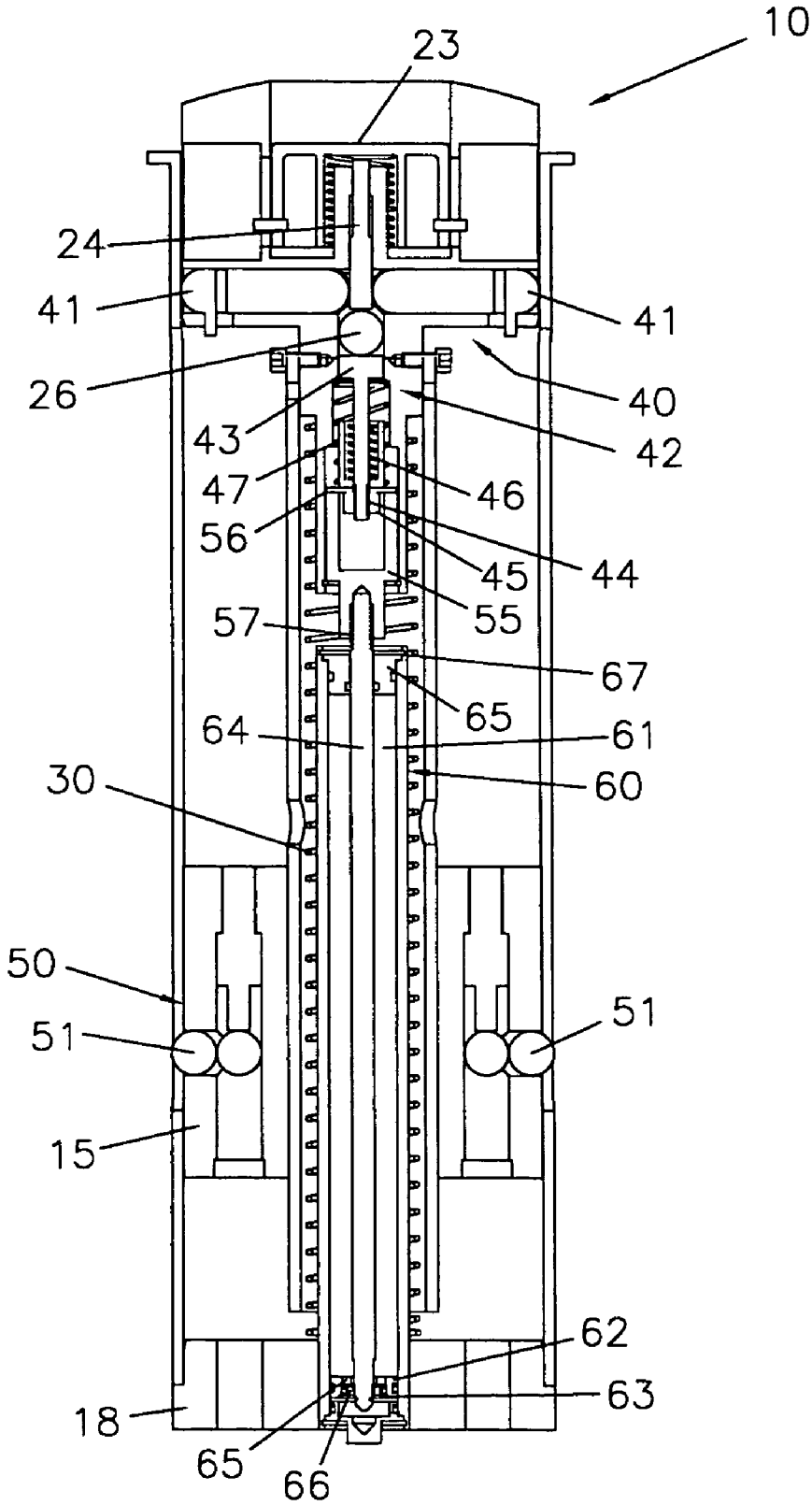
FIG. 4 is an elevated cross-sectional view of the present invention in the retracted position, with the release button depressed, ready to proceed to the extended position.

The top surface of the upper stand 12 is dome-shaped, as is shown in FIG. 2. This dome shape allows for ease of visibility when the present invention is mounted in the ground at golf courses and practice ranges. When the holding rack 17 is in the retracted position, the holding rack 17 is set within the outer housing 20 assembly and maintained by an upper stand latching mechanism 40, which connects with the latch recess slots 22 located in the outer wall 19 of the outer housing 20, as is shown in FIG. 4.

Figure 3:
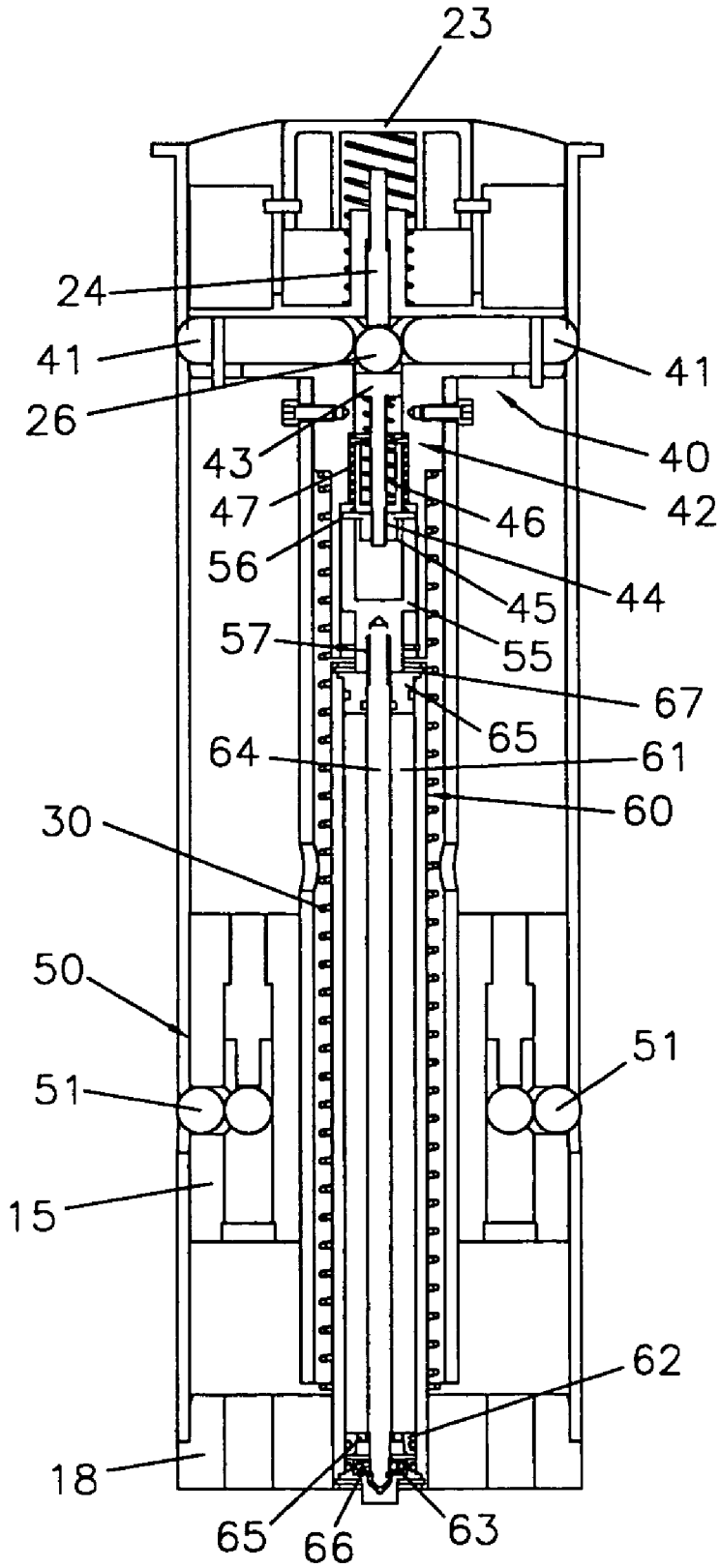
FIG. 3 is an elevated cross-sectional view of the present invention in a retracted and latched position.

When the user wishes to extend the holding rack 17, a spring-loaded push button 23, shown in FIG. 3, located on the top surface of the upper stand 12, is depressed. When depressed in a downward direction, the push button 23 actuates a release pin 24 to release the latching mechanism in the upper stand 11 and to allow for the extension of the holding rack 17 from the outer housing 20. The release pin 24, as is shown in FIG. 4, is a cylindrical device located internally to the push button 23. The push button 23 is designed so that it depresses approximately ½ inch before it activates the release pin 24. This feature prevents the inadvertent release of the upper stand latching mechanism 40 by individuals walking over the device or by a lawn mower.

Once the latch pins of the upper stand latching mechanism 41 are released from the latch recess slots 22, the holding rack 17 begins to extend from the outer housing 20 by means of a main push-up compression spring 30 connected to the bottom surface 18 of the outer housing 20 and through the holding rack 17. Only the upper stand 11 and the connector tube 14 are extended outside of the outer housing 20. The lower stand 15 remains within the outer housing 20.

Figure 5:
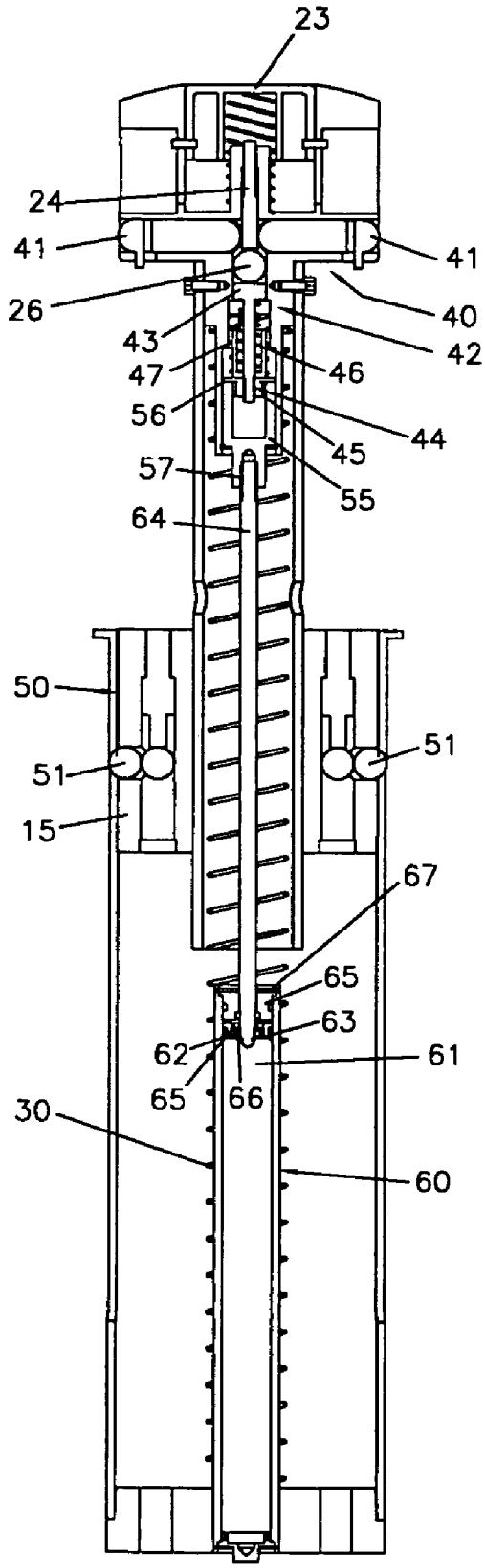
FIG. 5 is an elevated cross-sectional view of the present invention in the fully extended position.
Figure 6:
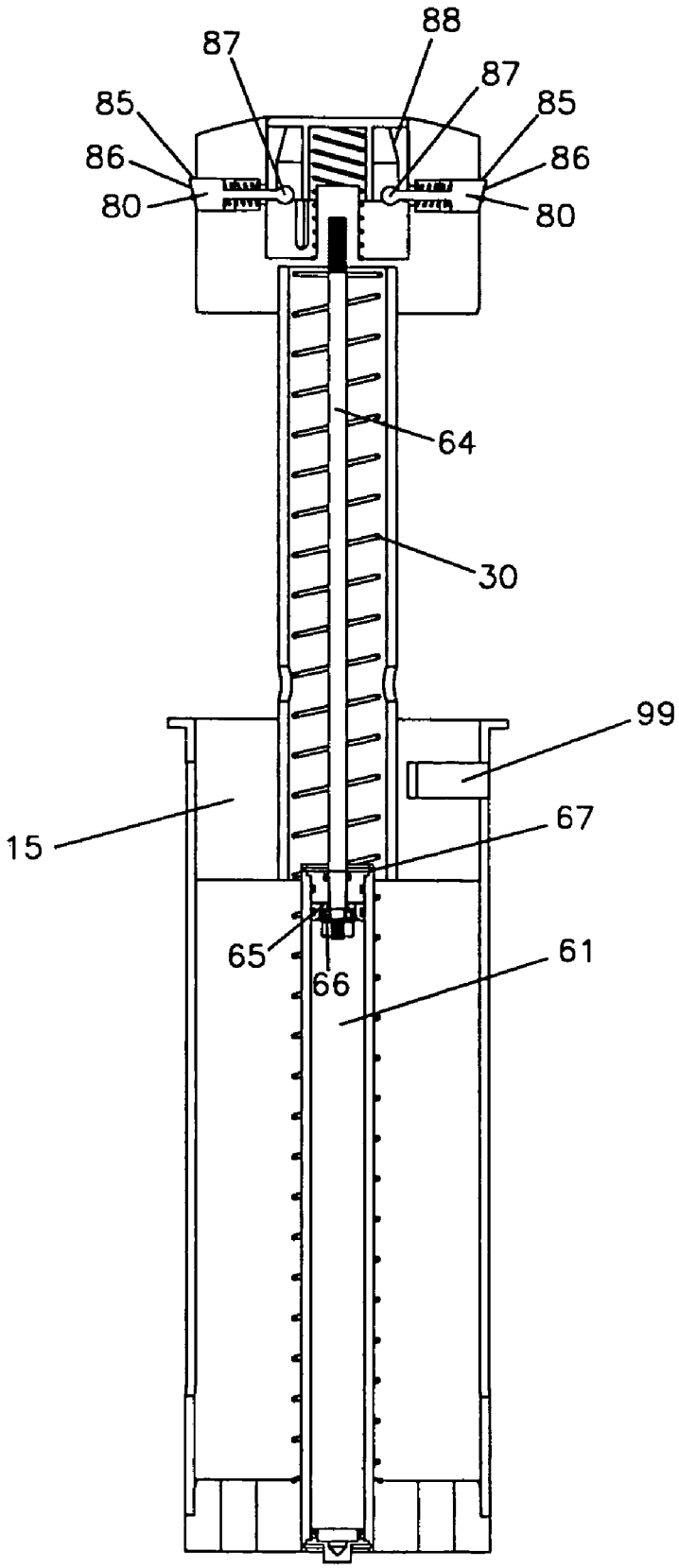
FIG. 6 is an elevated cross-sectional view of an alternative embodiment of the present invention with no latching mechanism in the lower stand.

The lower stand 15 also has a lower stand latching mechanism 50. In both the retracted and the extended position, the latch pins of the lower stand latching mechanism 51 engage within the latch recess slots 22 of the outer housing 20, as is shown in FIGS. 4, 5 and 6. In the retracted position, the latch pins 51 are located in the lower end of the latch recess slots 2. As the main push-up spring 30 pushes the holding rack 17 from the outer housing 20, the latch pins 51 slide along the latch recess slots 22 until they reach the upper end of the latch recess slots 1. The latch pins 51 act as a stop mechanism for the holding rack 17, preventing it from fully extending from the outer housing 20. The lower stand 15 does not extend from the outer housing 20. Once the holding rack 17 is fully extended, the golf club handle can be inserted into the cylindrical slots of the upper stand 11.

Various types of latching mechanisms could be utilized in the upper and lower stands 11, 15 of the present invention. The latching mechanism shown in FIGS. 3, 4 and 5 has two upper stand latch pins 41 which extend outward into latch recess slots 22 of the outer housing 20, preventing upward spring pressure from extending the holding rack 17. A center ball 26 is maintained between the two latch pins 41 and serves to keep the latch pins 41 engaged in the latch recess slots 22 of the outer housing 20, as is shown in FIG. 3. The latch pins 41 are cylindrical devices with spherical ends. FIG. 4 shows that upon activation of the release pin 24, the center ball 26 is moved downward from between the two latch pins 41, allowing the latch pins 41 to move inward toward the center axis, thus freeing the holding rack 17 to move in the extended position.

As the upper stand 11 just begins to extend, the downward pressure to the push button 23 is maintained, and the main push-up spring 30, applies an upward force that causes the inward movement of the latch pins 41, releasing the holding rack 17 to extend from the outer housing 20 assembly. Once the upper stand 11 has moved a short distance, the latch pins 25 are retained in a recessed position by the outer housing 20. At this point, the push button 23 may be released.

As the center ball 26 of the latching mechanism of the upper stand 40 is moved out from between the latch pins 41, it presses on a spring-loaded cylinder 42, which is shown in FIGS. 3, 4 and 5. The spring-loaded cylinder 42 is a round pin with a solid cylindrical piston 43 on one end, which is acted upon by the center ball 26 and a threaded end 44 to which a nut 45 is attached. A cylinder spring 46, a compression-type spring, maintains expansive tension to the latch pin 41 by providing upward pressure.

The threaded end 44 of the spring-loaded cylinder 42 fits within the cavity of a reset pin 55. The reset pin 55, as is shown in FIGS. 3, 4 and 5, is a cylinder with a first and second end 56, 57 and the first and second end each having a different diameter. The first end of the reset pin 56 forms a cavity in which the nut 45 on the threaded end of the spring-loaded cylinder 44 resides. The second end 57 of the reset pin 55 is solid and is cylindrical in shape.

After the upper stand 11 has been raised slightly, the reset pin drops down, seating on a snap ring, and the spring-loaded cylinder 42 becomes fully extended. A washer and nut 45 retain the second end of the spring-loaded cylinder 42 within the cavity of the reset pin 55. At this point, the release pin 24 is static and has no force from the spring-loaded cylinder 42 to return it, or the center ball 26, to the rest position.

The latch pins of the upper stand 41 exit the outer housing 20 assembly, and the latch pins 41 are static with no force applied to them. The upper stand 11 continues to rise until the latch pin in the lower stand 51 reaches the upper end 1 of the latch recess slots 22.

A damper mechanism 60 can also be placed within the golf club holding rack 10, as shown in FIGS. 3, 4, 5 and 6. The hydraulic damper shown is an oil-filled cylinder 61 which has a damping rod 64 that exits the upper end of the cylinder 61. The cylinder 61 is sealed with a static seal 65 at the upper end. The damping rod 64 is connected to the second end of the reset pin 57 and runs the length of the cylinder 64 on the damper mechanism 60 and runs through an outer piston 62 and is connected to the inner piston 63. The outer piston 62 is designed to have orifices that allow a high rate of flow and does not restrict the motion of the holding rack 17. The inner piston 63 has orifices 66 that are smaller than the orifices in the outer piston 65 and, when the inner piston 63 is drawn within the center of the outer piston 62, it forces the oil to flow through the orifices of the inner piston 66 first, resulting in a flow restriction.

As the holding rack 17 is extended from the outer housing 20, the damping rod 64 pulls the inner piston 63 up into the outer piston 62. The damper mechanism 60 is designed to have very little drag when the holding rack 17 is being pushed downward into the outer housing 20 and to exert a drag force when the holding rack 17 is moving upward. Once the two pistons 62, 63 are fit together, the flow restriction continues for the remaining upward travel of the holding rack 17. FIG. 5 shows the holding rack 17 in the fully extended position. Once the holding rack 17 begins its retraction into the outer housing 20, the outer friction created by the outer piston 62 as it descends down the cylinder 61 forces the inner piston 63 free from the outer piston 62, which allows the free flow of the oil, through only the large orifices of the outer piston 65. When this damper mechanism 60 is utilized, an additional spring 47 is placed around the spring-loaded cylinder 42, exerting downward pressure on return pin 55, to assist in overcoming the frictional pressure that is created by the pistons 62, 63 when retracting the holding rack 17 into the outer housing 20. This prevents the latch pins 41 being reset prior to reaching the outer housing 20.

In this embodiment, when the holding rack 17 is retracted into the outer housing 20 assembly, the second end of the reset pin 57 abuts against the top end 67 of damper's cylinder 61. Once the reset pin 57 comes into contact with the cylinder 61, the cylinder spring 46 in the spring-loaded cylinder 42 begins to push up on the center ball 26, applying pressure to the upper stand latch pins 41. The upper stand latch pins 41 are prevented from returning to the latched position by the outer housing 20. Once the latch pins of the upper stand 41 reach the latch recess slots 22, the center ball 26 forces the latch pins 51 outward, returning all the components to the engaged position.

An alternative embodiment of the present invention which utilizes the damping rod 64 as the stop mechanism for the holding rack 17 and does not utilize a lower stand latching mechanism 50 is shown in FIG. 6. The stop mechanism occurs as the outer/inner pistons 62, 63 abut against the static seal 65 of the cylinder 61. An anti-rotation pin 99 is located in the lower stand 15 to ensure alignment of the upper stand latch pins 41 with the latch reset slots 22.

Figure 7:
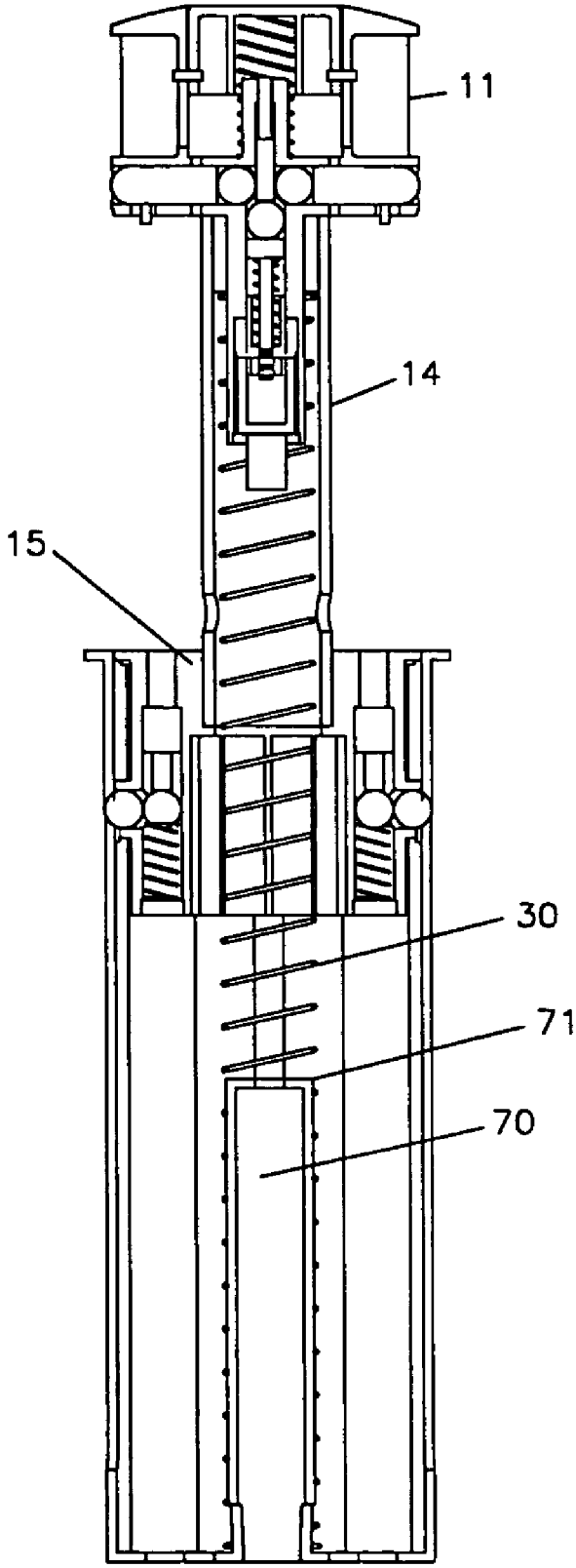
FIG. 7 is an elevated cross-sectional view of an alternative embodiment of the present invention with no damper mechanism.

The present invention could also be made without a damper mechanism, as is shown in FIG. 7. In this embodiment, a latch reset post 70 is located in the outer housing 20 assembly and attached to the bottom surface 18. When the holding rack 17 is retracted into the outer housing 20, the second end of the reset pin 57 abuts against the top end of the latch reset post 71. The upper stand latch pins 41 continue to have no outward force applied to them until they are a short distance from the outer housing 20. Once the reset pin 57 comes into contact with the latch reset post 70, the cylinder spring 46 in the spring-loaded cylinder 42 begins to push up on the center ball 26, applying pressure to the upper stand latch pins 41. The upper stand latch pins 41 are prevented from returning to the latched position by the outer housing 20. Once the latch pins of the upper stand 41 reach the latch recess slots 22, the center ball 26 forces the latch pins 51 outward, returning all the components to the engaged position.

Other types of alternative latching mechanisms could be utilized in the present invention, as shown on the upper stand in FIG. 6, which shows a spring-loaded latch pin 80. This latch pin 80 on one end has a flat top surface and is beveled on the side surface facing the outer housing 20 and on the other end has rounded heads 87. The latch pin 80 would always be biased on popping out. Once the latch pins 80 are out of the housing or in the latch recess slots 22 of the outer housing 20, they would freely extend. In this latching mechanism, a cam 88 is present in the push button 23, which wedges the rounded heads 87 of the latch pins 80 in towards the center and releases them. Other similar latching mechanisms could also be utilized in the upper and lower stands. As the latch pins 80 travels through the open end 21 of the outer housing 20, the outer wall 19 forces the latch pins 80 inward.

Figure 8:
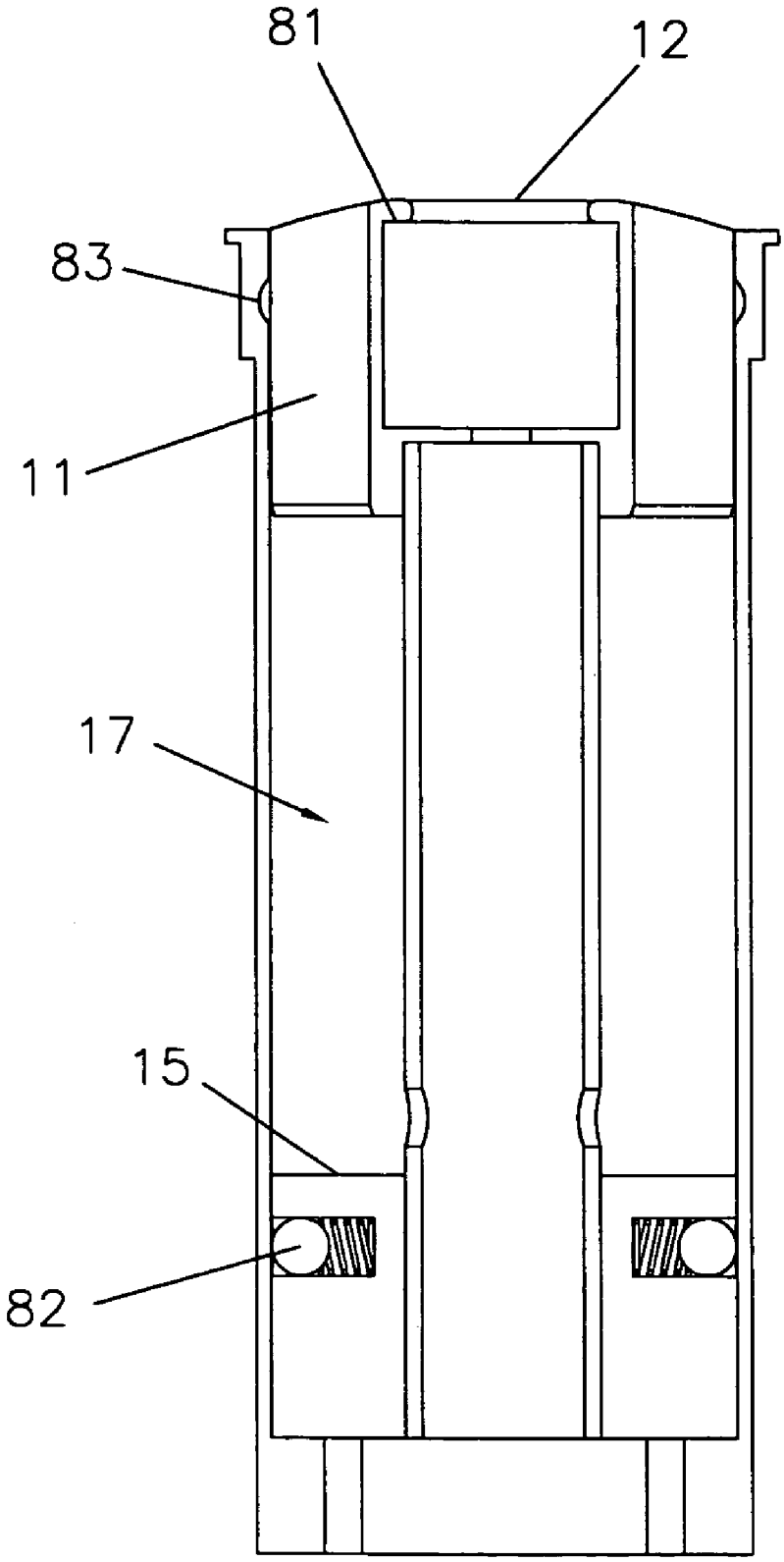
FIG. 8 is an elevated cross-sectional view of an alternative embodiment of the present invention with no spring mechanism.
Figure 9:
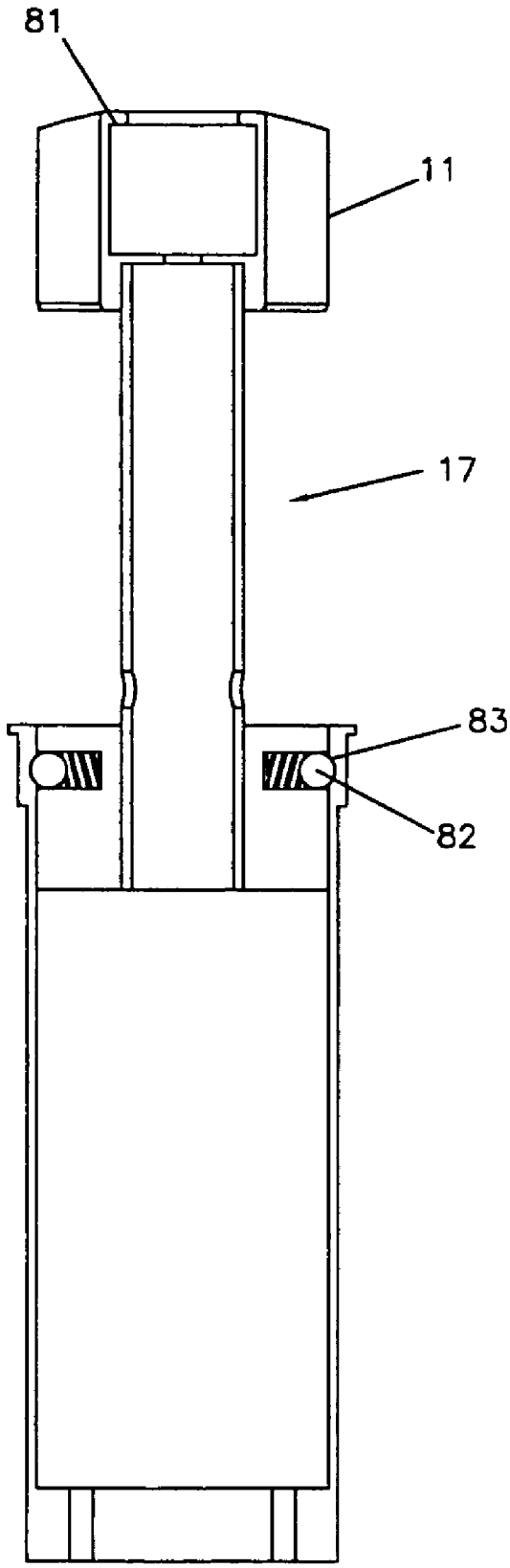
FIG. 9 is an elevated cross-sectional view of the alternative embodiment shown in FIG. 8 in the extended position.

FIG. 8 and FIG. 9 show another embodiment of the present invention without the spring mechanism. In this embodiment, the holding rack 17 can be extended manually by pulling on a lip 81 extending out from the top surface of the upper stand 12. The user may utilize the head of a golf club, a finger or any similar object to extend the holding rack 17. FIG. 9 shows how once the holding rack 17 is extended it is maintained in the extended position by a spring-loaded ball 82, which is present in the lower stand 15, and which engages into a spherical groove 83 located on the outer wall of the outer housing 19. The holding rack is retracted into the outer housing 20 merely by applying pressure to the upper stand 11.

The foregoing detailed description is given primarily for clearness of understanding, and no unnecessary limitations are to be understood therefrom, for modifications will become obvious to those skilled in the art upon reading this disclosure and may be made without departing from the spirit of the invention and scope of the appended claims.

I claim:

1. A golf club holding rack, comprising:

an outer housing assembly having an outer wall, a bottom surface and an open top end;

a holding rack having an upper stand, a lower stand and a connector tube, wherein said upper stand of said holding rack has an upper surface having a spring-loaded push button and a release pin connected to said latching mechanism;

a latching mechanism located in said upper stand of said holding rack, wherein said latching device is spring-biased and located in said upper stand of said holding rack; and a compression spring located within said outer housing and contacting said holding rack.

2. A golf club holding rack, comprising:

an outer housing assembly, said outer housing assembly having an outer wall and a bottom surface;

a holding rack, having an upper stand, a lower stand and a connector tube connecting said upper stand to said lower stand;

a spring-biased mechanism affixed to said holding rack and said outer housing; and, a latching mechanism interposed between said outer housing assembly and said holding rack, wherein said latching mechanism is located in said upper and said lower stand of said holding rack.

* * * * *

UNITED STATES PATENT AND TRADEMARK OFFICE
Certificate

Patent No. 7,124,899 B1 Patented: October 24, 2006

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Rondal Brent Wright, Glasgow, KY (US); and Paul T. Scherer, Lexington, KY (US).

Signed and Sealed this Eleventh Day of September 2007.

BRIAN GLESSNER
*Supervisory Patent Examiner*
Art Unit 3676